US005344538A

United States Patent [19]

Chamberlain et al.

[11] Patent Number: 5,344,538

[45] Date of Patent: Sep. 6, 1994

[54] THIN PLATE ANODE

[75] Inventors: Jamie H. Chamberlain, Concord; Adam G. Bay, Chesterland; Robert D. DeWitt, Highland Heights, all of Ohio

[73] Assignee: Gould Inc., Eastlake, Ohio

[21] Appl. No.: 2,596

[22] Filed: Jan. 11, 1993

[51] Int. Cl.[5] ..... C25D 17/12; C25D 17/16

[52] U.S. Cl. ..... 204/212; 204/242; 204/272; 204/275; 204/286; 204/290 R

[58] Field of Search ..... 204/280, 286, 288, 297 R, 204/289, 290 R, 242, 212, 272, 275

[56] References Cited

U.S. PATENT DOCUMENTS

| | | | |
|---|---|---|---|
| 2,518,593 | 11/1952 | Rossel | 204/199 |
| 3,151,048 | 9/1964 | Conley et al. | 204/13 |
| 4,051,000 | 9/1977 | Gendron et al. | 204/106 |
| 4,129,492 | 12/1978 | Morton et al. | 204/212 |
| 4,291,216 | 9/1981 | Takayasu | 219/118 |
| 4,318,794 | 3/1982 | Adler | 204/216 |
| 4,323,441 | 4/1982 | Schaer et al. | 204/224 R |
| 4,347,115 | 8/1982 | Espenhahn et al. | 204/206 |
| 4,401,541 | 8/1983 | Kobayashi | 204/206 |
| 4,419,192 | 12/1983 | Dahms | 204/15 |
| 4,490,218 | 12/1984 | Kadija et al. | 204/13 |
| 4,529,486 | 7/1985 | Polan | 204/13 |
| 4,565,607 | 1/1986 | Hanak et al. | 204/38.1 |
| 4,772,361 | 9/1988 | Dorsett et al. | 204/28 |
| 4,778,571 | 10/1988 | Nakatsugawa | 204/13 |
| 4,793,902 | 12/1988 | Furuya et al. | 204/13 |
| 5,017,275 | 5/1991 | Niksa et al. | 204/204 |
| 5,094,735 | 3/1992 | Lang, Jr. | 204/288 |

*Primary Examiner*—Kathryn Gorgos
*Attorney, Agent, or Firm*—D. Peter Hochberg; Mark Kusner; Michael Jaffe

[57] ABSTRACT

An anode adapted to be immersed in an electrolytic solution adjacent a moving cathode. The anode is comprised of an electrical conductive grid which is clad with an insoluble metal. The grid has a plurality of anode mounting surfaces formed thereon; the mounting surfaces being formed of an insoluble, conductive metal and being in electrically conductive engagement with the conductive grid. The mounting surfaces are dimensioned to position and support side-by-side a plurality of relatively thin insoluble metal anode plates. The anode plates are shaped to be mounted to the mounting surfaces by the lateral edges thereof wherein current may be applied to the anode plates through the mounted edges. The anode plates are dimensioned such that they form a generally continuous anode surface which conforms to the moving cathode.

15 Claims, 6 Drawing Sheets

THIN PLATE ANODE

FIELD OF THE INVENTION

The present invention relates generally to the art of electrodepositing metal, and more particularly, to an anode assembly for use in such processes. The present invention is particularly applicable to an anode assembly adapted for high amperage applications in the forming of copper foil and will be described with particular reference thereto; it being understood, however, that the present invention may also find advantageous application in electroforming of other metal foils or in applications utilizing low amperage.

BACKGROUND OF THE INVENTION

The basic technique in forming electrodeposited foil has not changed greatly over the years. In this respect, electrodeposited copper foil is generally formed by immersing a rotating drum cathode in an electrolyte solution containing copper ions. An anode formed from one or more arcuate sections of electrolytically conductive material is immersed in the electrolyte solution and positioned adjacent the drum cathode. The anode is formed to have a surface generally conforming to the curvature of the drum cathode to define a uniform inner electrode gap therebetween. Copper foil is formed on the rotating drum cathode by applying a current, having a current density lower than the limiting current density of the electrolyte solution, to the anode and cathode. The electrodeposited foil is continually removed from the drum cathode as it emerges from the electrolyte solution so as to permit continuous foil production.

It is well known in the art that the most important parameter in forming deposited foil of high quality and uniform thickness is that the current density along the inner electrode gap. In this respect, it is necessary that the current density along the inner electrode gap be as consistent and constant as possible to ensure uniform deposition of metal on the drum cathode. The design of the anode assembly surrounding the drum cathode is thus extremely important, and it is critical that a uniform, accurate spacing be established and maintained between the drum cathode and the anode. If the distance between the anode and drum cathode varies from area to another, the cathode's current density in the area of greater distance is less which reduces the deposition of metal in that area. In another respect, the conductive characteristics, i.e., the current carrying characteristics, of the anode material are also important in establishing a uniform current density across the surface thereof.

In an effort to maintain a uniform, inner electrode gap, attempts have been made to utilize an anode material which will not react with the electrolyte solution, such as titanium, stainless steel, chromium, columbium, tantalum, or an alloy thereof. These metals are generally non-reactive with electrolyte fluid and provide the dimensional stability desired to maintain a uniform electrode gap. These materials are, however, relatively poor electrical conductors (as compared to copper), and anode designs known heretofore do not lend themselves to utilization of these materials. In this respect, anode designs known heretofore generally utilize thick, elongated bars or thick, flat plates which are bent or formed to have a curved configuration conforming to the curvature of the drum cathode. These bars or plates are fairly massive so as to maintain dimensional stability under the considerable hydraulic pressure exerted thereagainst by the rotating drum cathode, and are typically electrically charged along the peripheral edges thereof. Because of the poor electrical properties of such materials, considerable electrical power is required to charge such components; yet, current distribution throughout the plates or bars may be poor due to the resistance of such materials. This may result in uneven current densities along the surface of the anode and inefficiency due to the loss of electrical power through heat loss.

The present invention provides an anode assembly which utilizes thin, rigid preformed anode plates formed of an inert conductive metal, which plates are mounted onto an anode grid formed of a highly conductive metal which is encased in a protective cladding.

SUMMARY OF THE INVENTION

According to the present invention, there is provided an anode structure adapted to be positioned adjacent a cathode having a predetermined shape. The anode structure includes a conductive anode grip formed of a core of copper or an alloy thereof, having a protective coating encasing said copper core. Spaced-apart mounting means formed of an inert, conductive metal are mounted to said grid to be in electrical contact with said copper core. A thin, rigid anode sheet having an active anode portion is provided and formed to have a predetermined configuration generally matching the predetermined shape of said cathode and spaced-apart anode edge portions. Means for mounting are provided to receive the anode edge portions wherein the active anode portion maintains its predetermined configuration and is substantially unsupported between the spaced-apart anode mounting means.

In accordance with another aspect of the present invention, there is provided an anode assembly for use with a rotating drum cathode in an electrolytic solution in an electrodeposition process. The anode assembly includes a conductive grid dimensioned to be positioned within the electrolytic solution adjacent the drum cathode. The grid is comprised of a copper core and a titanium layer totally encasing the copper core which is exposed to the electrolytic solution. A plurality of relatively thin, rigid titanium anode plates are formed to have a concave cross-section with a radius of curvature slightly greater than the radius of curvature of the drum cathode and a width equal to a predetermined circumferential portion of the drum. A plurality of spaced-apart mounting means are provided on the grid for positioning and mounting the anode plates thereto, the mounting means being in electrically conductive engagement with the copper core and positioning the anode plates side-by-side about the drum cathode wherein the anode plates form a generally continuous surface about the immersed portion of the drum cathode. Each of the surface means engages the adjacent lateral edges of adjacent anode plate such that each plate is supported by its lateral edges, the edges being secured to the mounting means wherein current maybe applied to each anode plate through the lateral edges thereof.

It is an object of the present invention to provide an anode assembly for use in electrodepositing metal onto a cathodic surface.

Another object of the present invention is to provide an anode assembly for use with a rotating drum cathode for electrodepositing metal thereon, wherein a uniform gap is formed between the drum cathode and the anode assembly.

Another object of the present invention is to provide an anode assembly as described above wherein the anode assembly is comprised of a plurality of relatively thin plates having a preformed configuration generally matching the cathode drum, each plate being mounted along its lateral edge to a conductive grid.

Another object of the present invention is to provide an anode assembly as described above wherein the current density above the active anode surface is generally uniform across the foil width and varies only slightly across the interelectrode gap.

A still further object of the present invention is to provide a plurality of anode plates mounted to an electrically conductive grid, wherein each plate is electrically connected to the grid along the edges thereof.

A still further object of the present invention is to provide an anode assembly as described above wherein the anode plates are removable from the electrically conductive grid.

A still further object of the present invention is to provide an anode assembly as described above wherein said grid is formed of a highly conductive metal encased in a cladding formed of an inert metal.

A still further object of the present invention is to provide a conductive anode support grid wherein said grid is comprised of a copper core encased in a titanium cladding, and said anode plates are titanium and are welded along the edges thereof to said anode grid.

These and other objects and advantages will become apparent from the following description of a preferred embodiment of the invention taken together with the accompanying drawings.

BRIEF DESCRIPTION OF DRAWINGS

The invention may take physical form in certain parts and arrangement of parts, a preferred embodiment of which will be described in detail in the specification and illustrated in the accompanying drawings which form a part hereof and wherein.

DETAILED DESCRIPTION OF PREFERRED EMBODIMENT

Figure 1:
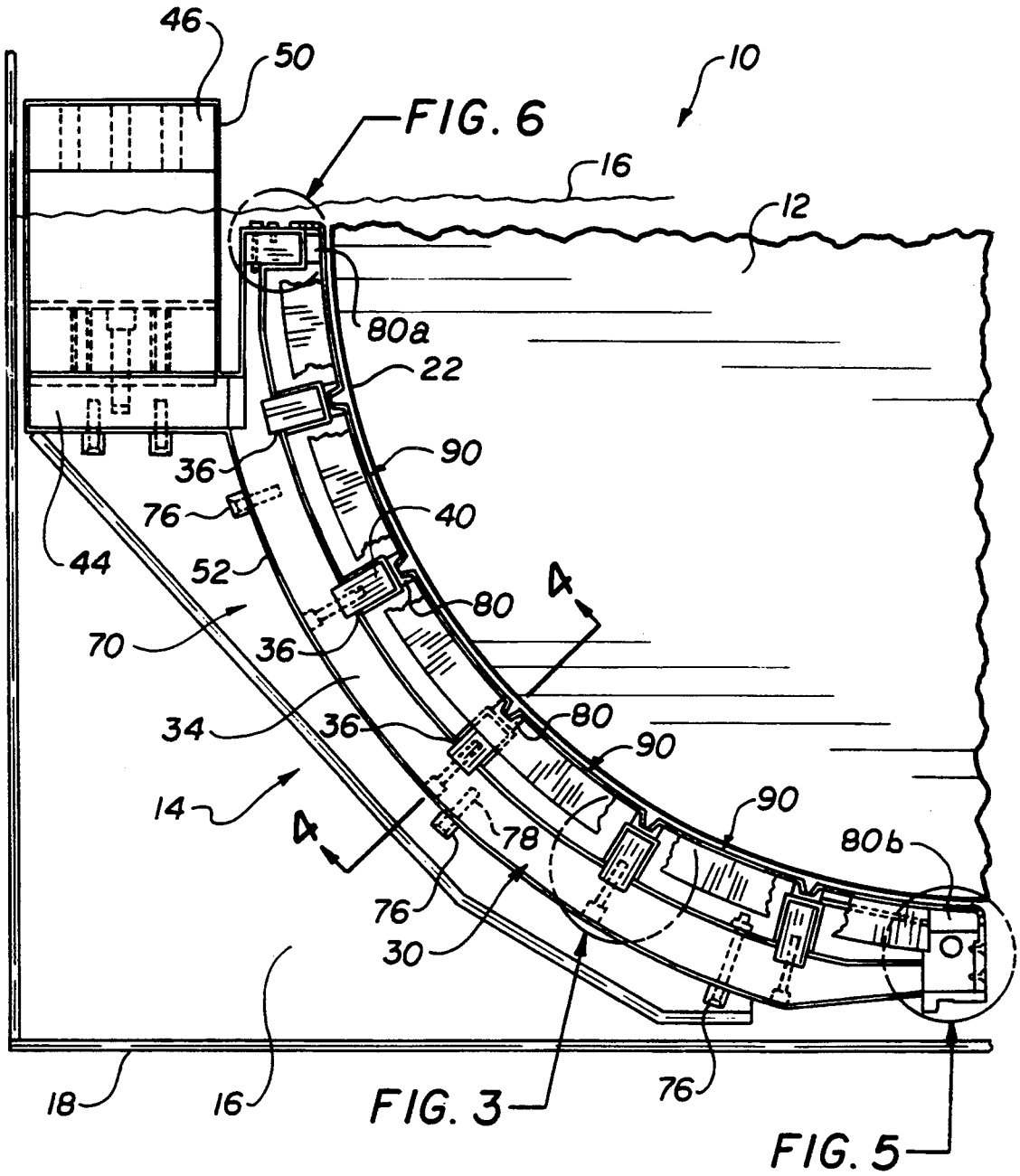
FIG. 1 is an end elevational view of a portion of an electrolytic cell illustrating a preferred embodiment of the present invention.

Referring now to the drawings wherein the showings are for the purpose of illustrating a preferred embodiment of the invention only, and not for the purpose of limiting same, FIG. 1 shows an electroforming cell 10 for electroforming metal foil, illustrating a preferred embodiment of the present invention. The present invention is particularly applicable for forming copper foil and will be described with reference thereto, although it will be appreciated from a further reading of the present disclosure that the present invention finds advantageous application in forming other metal foils, or for electrodeposition of metal on an existing metal surface.

Broadly stated, electroforming cell 10 is generally comprised of a drum cathode 12 and an anode, designated 14 in the drawings. Anode 14 and part of drum cathode 12 are immersed in electrolytic bath 16 contained within a tank 18.

Drum cathode 12 is generally cylindrical in shape and mounted by conventional means for rotation about a generally horizontal axis. Drum cathode 12 may be formed from any suitable electrically-conductive metal or metal alloy including lead, stainless steel, columbium, tantalum, titanium, or an alloy thereof. According to the present invention, drum cathode 12 is preferably comprised of a stainless steel drum having a polish plating surface 22. Plating surface 22 may be formed from titanium, columbium, tantalum, or an alloy thereof. Drum 12 may be rotated by any suitable motor drive arrangement (not shown) as is conventionally known in the art.

Figure 2A:
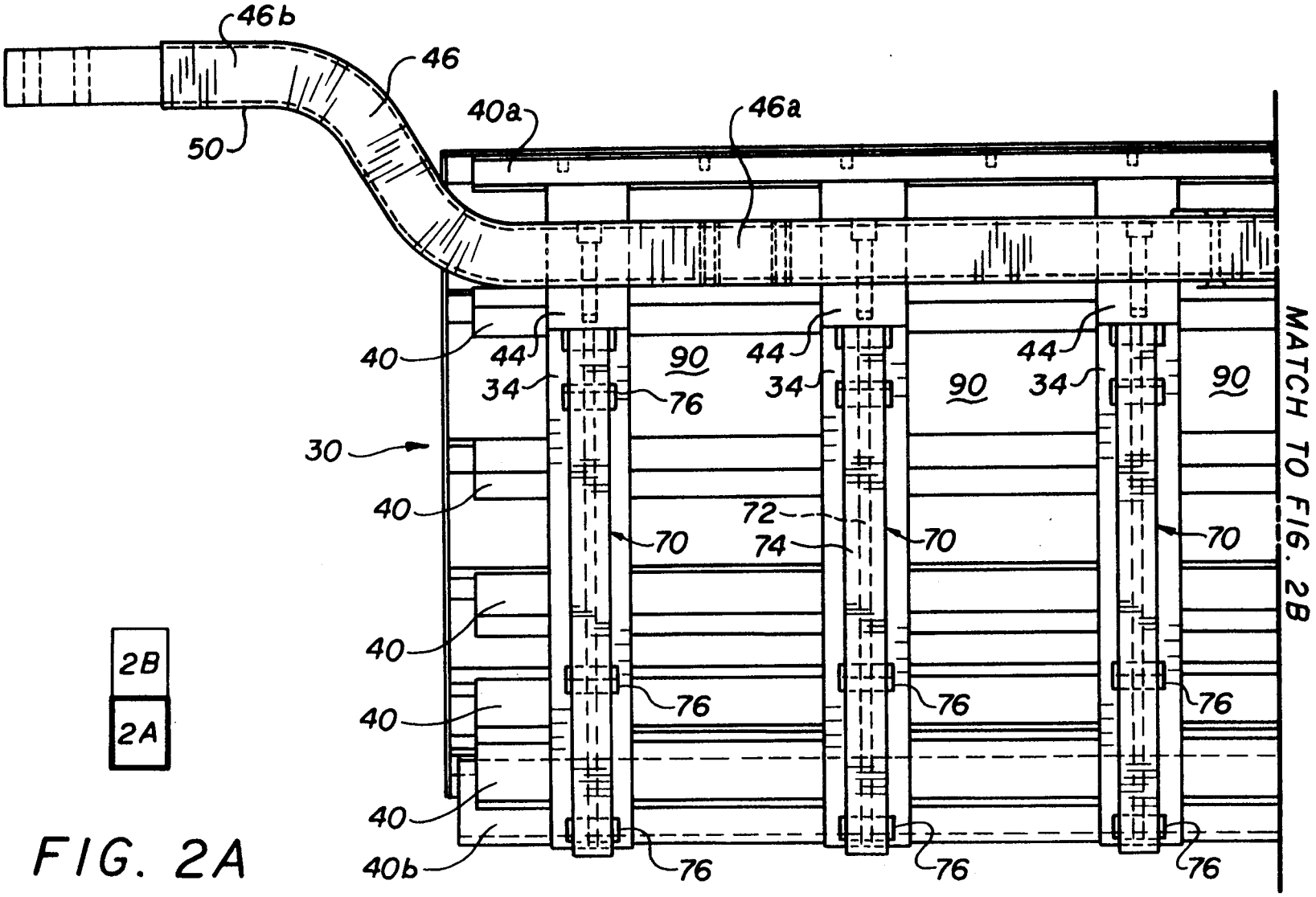
FIGS. 2A and 2B are side elevational views of the anode assembly shown in FIG. 1.
Figure 2B:
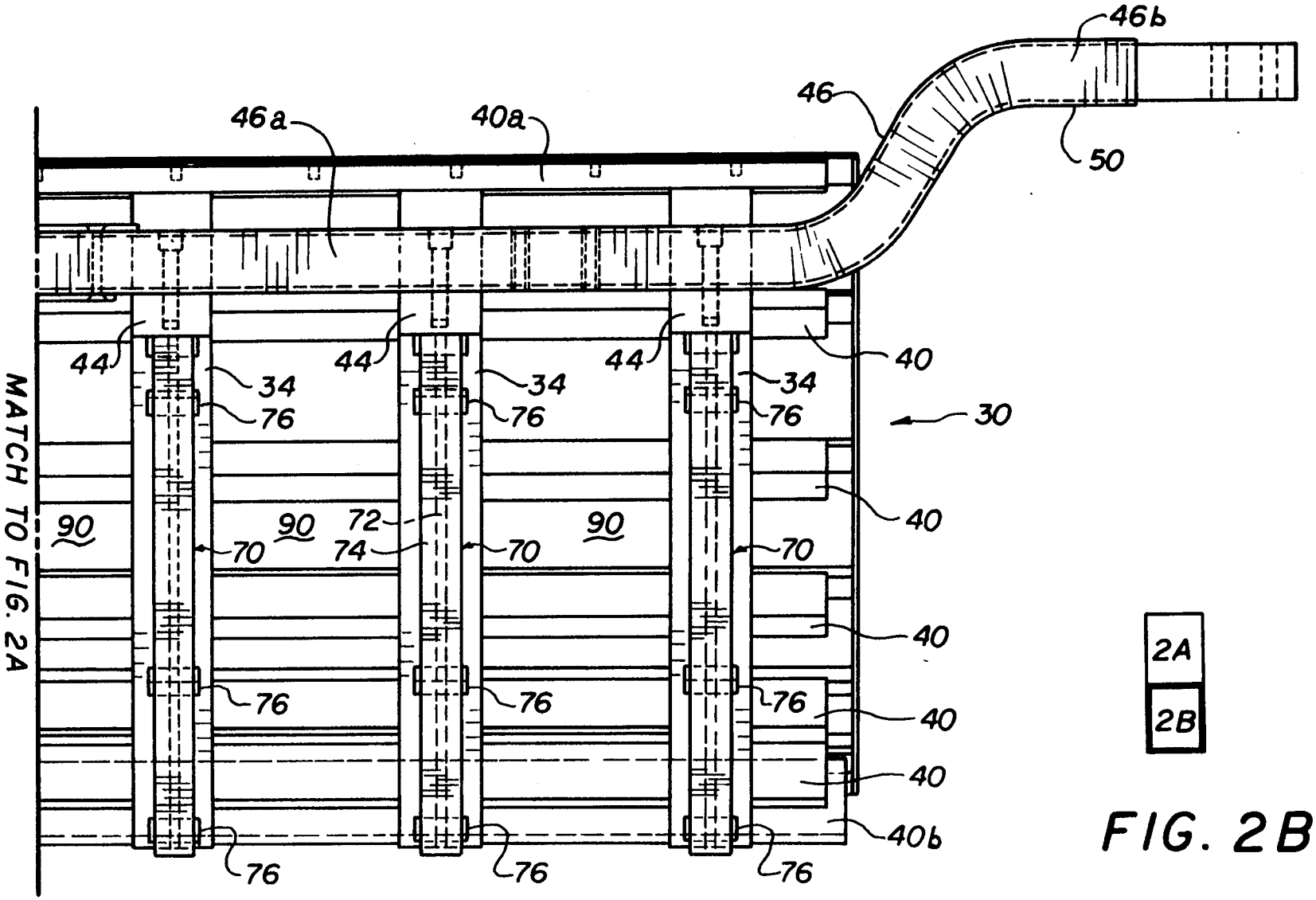
Figure 5:
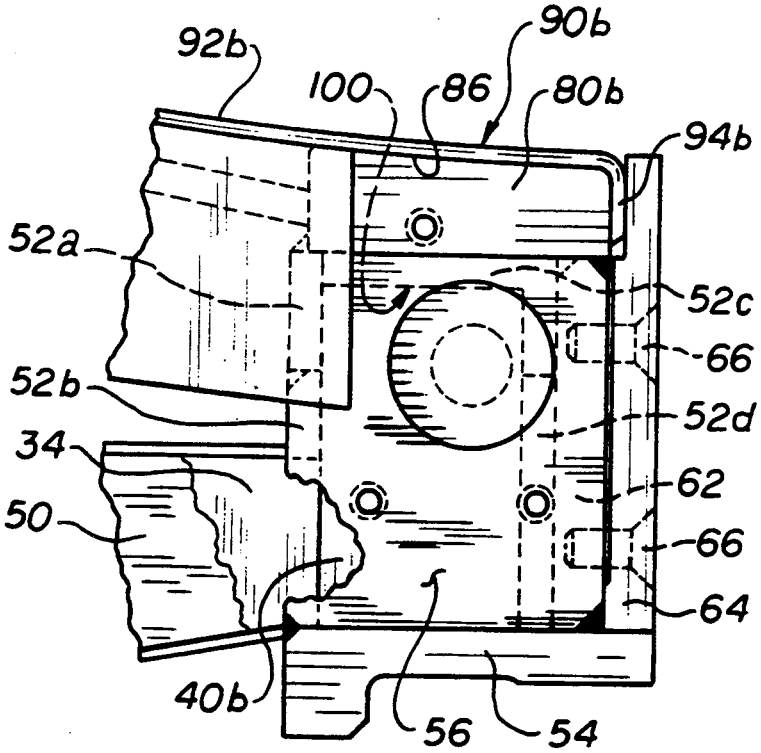
FIG. 5 is an enlarged view illustrating the mounting arrangement for the lowermost anode plate.
Figure 6:
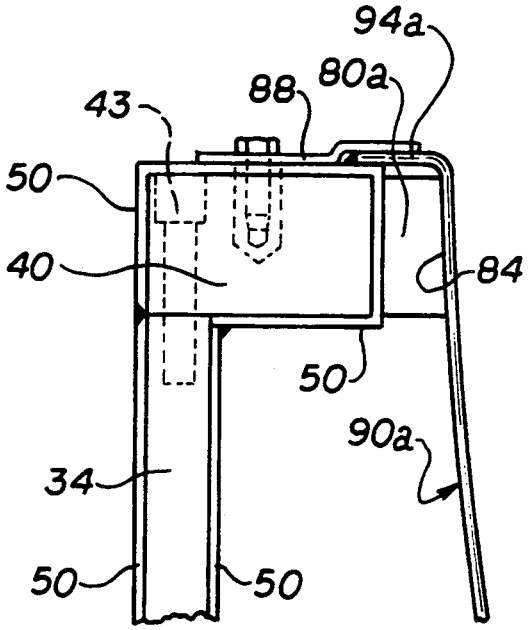
FIG. 6 is an enlarged view of area 6 of FIG. 1 illustrating the mounting arrangement for the uppermost anode plate.
Figure 7:
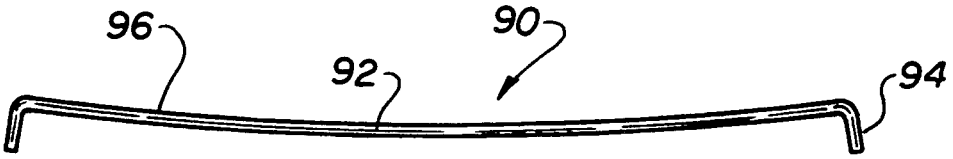
FIG. 7 is a cross-sectional view of an anode plate according to the present invention.
Figure 8:
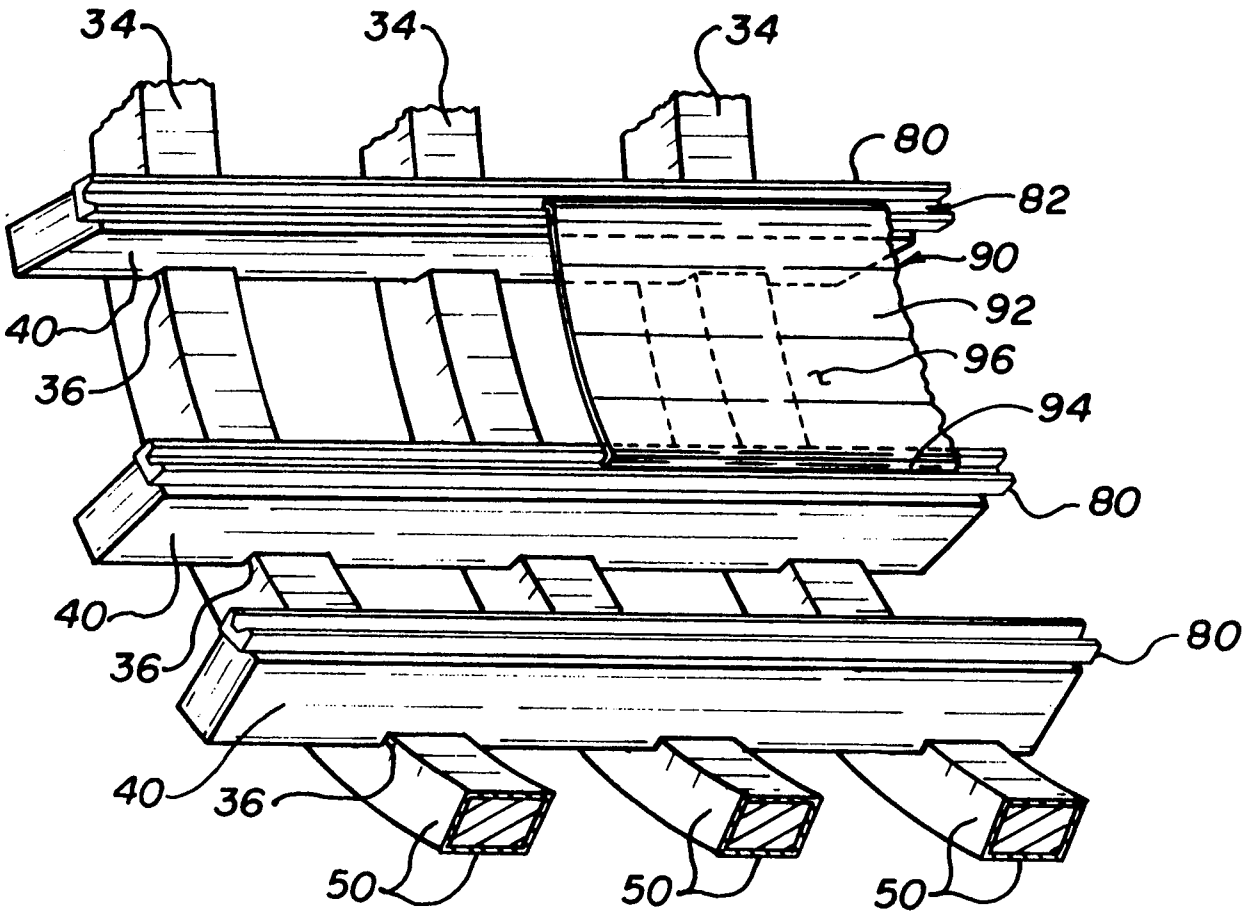
FIG. 8 is a partial perspective view of the anode assembly, showing an anode plate attached to the anode grid.

Anode 14 is basically comprised of an arcuate anode support grid 30 having a plurality of anode plates 90 attached thereto. According to the present invention, anode support grid 30 is essentially an electrical conductor for distributing electrical current to anode plates 90. To this end, anode support grid 30 is basically comprised of a plurality of spaced-apart, arcuate beams 34 formed of an electrically conductive metal, preferably copper or an alloy thereof. Each beam 34 is formed to include a plurality of spaced-apart recesses 36 along the concave side thereof. Recesses 36 are generally rectangular in shape, and the recesses 36 in adjacent beams being in alignment to receive elongated conductive bars 40 therein. Each conductive bar 40 is generally rectangular in cross-section and has a length sufficient to extend across each of the arcuate beams 34 so as to form a grid-like structure, best illustrated in FIGS. 2A, 2B. Conductive bars 40 are preferably formed of copper or a copper alloy, and are secured to arcuate beams 34 by conventional fasteners 42 best seen in FIG. 3. Special conductive bars **40*a*, 40*b* are provided at the upper and lower end of arcuate beams 34, as best seen in FIGS. 5 and 6. As shown in FIG. 6, special conductive bar 40*a* is secured to the upper ends of arcuate beams 34 by a conventional fastener 43. Similarly, the lower ends of arcuate beams 34 abut the side of special conductive bar 40*b*. In this respect, the respective mating surfaces of the beams 34 and bars 40, 40*a*, 40*b*** are preferably machined to close tolerances and smooth surface finishes such that the mating surfaces provide flush, surface-to-surface contact, to facilitate current distribution therethrough.

A laterally extending rectangular plate 44 is connected to each arcuate beam 34 at the upper end thereof. Plate 44 is preferably formed of copper or a copper alloy and extends from the convex side of arcuate beams 34, as best seen in FIG. 1. Plates 44 are secured to a conductive bus bar 46, best seen in FIGS. 2A and 2B. Bus bar 46 includes a central portion **46*a* which is secured to plates 44 and two end portions 46*b* which are in alignment with each other, but offset from central portion 46***a*. Bus bar 46 is secured to plate 44 by conventional fasteners extending therethrough. In this respect, plates 44 are essentially current distributors between bus bar 46 and arcuate beams 34.

As indicated above, the components forming anode support grid 30, i.e. bus bar 46, plates 44, bars 40, 40*a*, 40*b* and beams 34, are preferably formed of copper, or an alloy thereof. According to the present invention, the entire anode support grid 30 is encased in an outer jacketing or sleeve of inert metal. In the embodiment shown, the respective components of grid 30 are encased in a titanium cladding 50 best illustrated in FIG. 3, which cladding 50 is provided to surround the portion of grid 30 which would be exposed to the electrolytic bath 16. In the embodiment shown, the support grid 30 is basically jacketed by fitting and welding flat plates around the aforementioned structural members. As best seen in FIG. 5, special conductive bar 40*b* is encased by a plurality of plates 52*a*, 52*b*, 52*c*, 52*d*, including a bottom plate 54 and side plates 56. A first clamp half 62, shown in hidden lines in FIG. 5, is secured to plates. A second clamp half 64 is provided to mate with first clamp half 62 and is secured thereto by conventional flat head fasteners 66 which extend into first clamp half 62 through apertures in second clamp halve 64. According to the present invention, cladding 50, plates 52*a*, 52*b*, 52*c*, 52*d*, 54 and 56, and clamp valves 62, 64 are preferably formed of an inert metal such as titanium, stainless steel, columbium, tantalum, or alloys thereof. In the embodiment shown, such components are formed of titanium.

Figure 4:
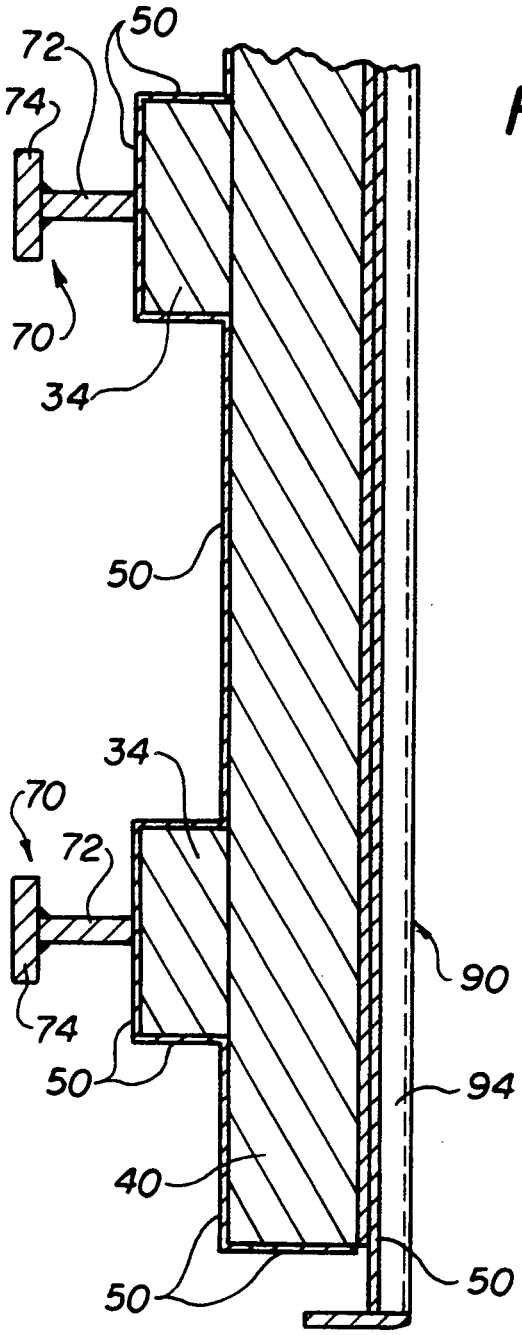
FIG. 4 is a sectional view taken along line 4—4 of FIG. 1.

A support gusset 70 is provided between arcuate beams 34 and the plate 44 to reinforce and provide support to the overall grid assembly. Support gusset 70, best illustrated in FIGS. 1 and 4, is comprised of a web 72 and flange 74. Mounting blocks 76 are secured to the flange 74 of support gusset 70. Support gusset 70 may be formed of any metal inert to electrolytic solution 16, but in the embodiment shown is formed of titanium. Titanium fasteners 78 extending through mounting blocks 76 extend into arcuate beams 34 and plate 44 to secure support gusset 70 thereto.

Figure 3:
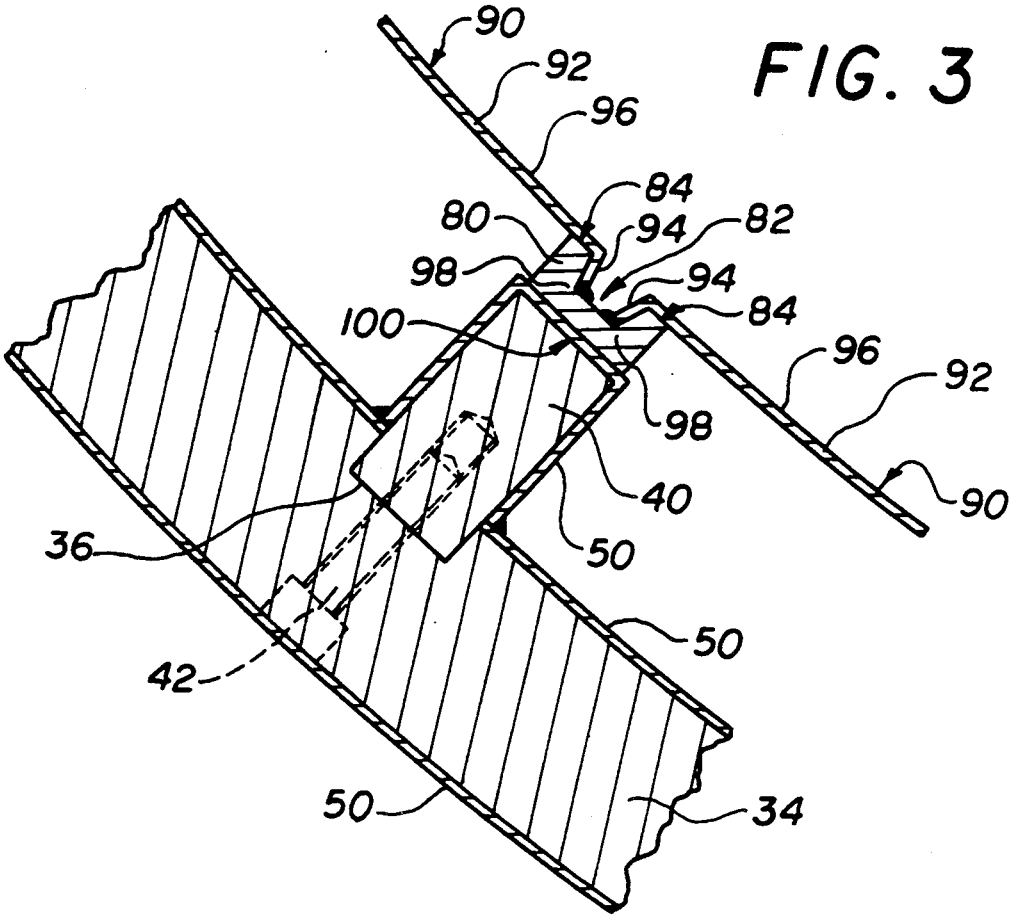
FIG. 3 is an enlarged view of the area shown in FIG. 1 illustrating a mounting location for anode plates forming a part of the present invention.

Referring now to FIG. 3, an anode mounting bar 80 is provided along the free sides of each grid conductor bar 40. Anode mounting bars 80 are generally rectangular in cross-section, and have a trapezoidal shaped channel 82 which extends longitudinally therethrough. A specially shaped top anode mounting bar 80*a* is provided along the upper grid connector bars 40*a*, as seen in FIG. 6. Top anode mounting bar 80*a* is generally rectangular in shape, and includes a concaved surface 84 facing drum cathode 12. A specially shaped lower anode mounting bar 80*b* is provided on the lower connector bar 40*b*, as best seen in FIG. 5. Lower anode mounting bar 80*b* is also generally rectangular in shape and has a concaved surface 86 facing drum cathode 12. According to the present invention, anode mounting bars 80, 80*a* and 80*b* are preferably formed of titanium or a titanium alloy and are secured to the titanium cladding 50 surrounding the copper conductive bars 40, 40*a* and 40*b* to form a fluid-tight barrier with cladding 50 to protect the copper components. To facilitate good electrical conductivity between the titanium cladding 50 and the titanium anode mounting bars 80, 80*a* and 80*b*, the respective mating surfaces of titanium cladding 50 and the titanium anode mounting bars 80, 80*a*, 80*b* are preferably machined to ensure good surface-to-surface contact therebetween.

According to the present invention, anode mounting bars 80, 80*a*, 80*b* are adapted to position and to support anode plates 90. In the embodiment shown, anode plates 90 are generally rectangular in shape and have a length corresponding to the length of drum cathode 12. Each anode plate 90 includes a central plate portion 92 and lateral edge portions 94. Central plate portion 92 of each plate 90 is formed to have a dished or contoured shape from edge-to-edge. More specifically, central plate portion 92 has a radius of curvature slightly larger than the radius of curvature of drum cathode 12. In addition, central plate portion 92 of each anode plate 90 has an active anode surface 96 on the concaved side thereof, which surface is an electrocatalytic coating. Lateral edges 94 of anode plates 90 are formed to extend away from drum cathode 12 and to be received within channels 82 formed in the anode mounting bars 80. In this respect, lateral edges 94 are formed to be at a predetermined angle relative to central plate portion 92 so as to be flush mounted to the tapered sides of the anode mounting bars 80, as best seen in FIG. 3. Special anode plates 90*a*, 90*b* are provided to be positioned at the upper and lower ends, respectively, of the anode grid 30. As best seen in FIG. 5, one lateral edge 94*a* of anode plate 90*a* is formed to conform to the upper mounting bar 80*a* and the other lateral edge of anode plate 90*a* is formed to be received within channels 82 in anode mounting bar 80. Similarly, one lateral edge 94*b* of anode plate 90*b* is shaped to conform to the lower mounting bar 80*b* and the other lateral edge of anode plate 90*a* is formed to be received within channels 82 in anode mounting bar 80.

Anode plates 90, 90*a* and 90*b* are preferably secured to the anode mounting bars 80, 80*a* and 80*b* by welding. In this respect, channel 82 is dimensioned to be wide enough to enable welding of the free ends of lateral edge portion 94 to the base of channel 82, as shown in FIG. 3. Importantly, the weld cross-section, designated 98 in the drawings, is preferably at least equal to the thickness of anode plate 90 to ensure an adequate current path from anode mounting bars 80, 80*a* and 80*b* to anode plates 90, 90*a* and 90*b*.

As seen in FIG. 6, lateral edge 94*a* of anode plate 90*a* is preferably welded to cladding 50 encasing conductor bar 40, and is further held in place by a clamp 88 which is held in place by a conventional fastener formed of titanium. Lateral edge 94*b* of anode plate 90*b*, best seen in FIG. 5, is held in position by clamp halves 62, 64.

The thickness of anode plates 90 is based upon the current to be conducted therethrough as well as the hydraulic pressure which will be exerted upon anode plate 90 by rotation of drum cathode 12. In this respect, anode plates 90 are preferably thin enough to conduct sufficient current, yet thick enough to support and resist deformation under the hydraulic pressure exerted by drum cathode 12. In this respect, anode plates 90 are preferably dimensioned to be between one-half inch (½") and one inch (1") thick. In the embodiment shown, titanium plate having a three millimeter thickness are used to form anode plates 90.

According to the present invention, anode support grid 30 is adapted to provide electrical current to anode plates 90. As will be appreciated, because most of the components forming anode support grid 30 are preferably copper or an alloy thereof, electrical current is easily conducted and distributed through such components. A copper/titanium interface, designated 100 in the drawings and best seen in FIGS. 3–5, is formed at the outer edges of conductive bars 80, 80*a*, 80*b* between the copper forming such bars and the titanium cladding 50 which surrounds and encases same. Because of the relatively poor conductive properties of titanium relative to copper, it is important that the respective surfaces are joined or united to produce an electrically conductive interface. An electrically conductive bond between the copper and titanium components may be accomplished in several ways. In one respect, the respective metals may be explosion bonded to each other by a conventionally known technique or alternatively, may be co-extruded by another known technique. In the embodiment shown, elongated copper bars of rectangular cross-section can be co-extruded to have a titanium casing surrounding the inner copper core. Referring now to FIG. 3, if a co-extruded bar as just described is formed, a portion of the casing may be machined away from one side or edge of the co-extruded bar to expose the inner copper core. The exposed copper core may then be machined to be received in recesses 36 in arcuate beams 34 and to mate with the copper forming such arcuate beams 34, as shown in FIG. 3. The titanium outer casing 50 may be welded to the titanium plates encasing the arcuate beam 34. Co-extruded copper bars having a titanium casing ensures a tight metallic and electrical bond between the layers of copper and titanium and thus, maximize the current flow therethrough.

Referring now to the operation of electroforming cell 10, current is provided to the ends of the copper bus bar through electrical connections (not shown) as is conventionally known. Bus bar 46 conducts current to plates 44 which in turn are electrically connected to arcuate beams 34 and elongated conductive bars 40, 40*a*, 40*b*.

As current flows from the copper core of the anode support grid 30, it is conveyed through the Cu/Ti interface 100 into the individual anode mounting bars 80, 80*a* and 80*b*. Current is conducted into anode plates 90, 90*a*, and 90*b* through lateral edge portions 94 thereof. Importantly, the current path from anode mounting bars 80, 80*a*, 80*b* is essentially established through the welds connecting anode plates 90, 90*a* and 90*b* to anode mounting bars 80, 80*a* and 80*b*. Because the current is distributed to each anode plate from the lateral edges thereof, a more uniform current distribution is provided across the active face of anode plates 90, 90*a* and 90*b*. In this respect, any uneven current distribution created by weld areas 98 are confined within later edge portions 94, and thus the current across central plate portion 92 is more evenly distributed. In other words, current hot spots normal found at electrical connections or weld areas are removed from the active surface area in the anode. In addition, the present invention provides an anode assembly wherein individual anode plates may be easily removed from the anode support grid 30 when its useful operative life is spent, by cutting away the used anode plate and replacing it with an anode plate having a newly coated active surface. Still further, an anode design according to the present invention is more efficient and cost effective, in that the reduced thickness of the plates reduces resistance to flow and at the same time, reduces heat loss due to resistance which would normally be found in larger, thicker bars.

The present invention has been described with respect to a preferred embodiment. Modifications and alterations will occur to others upon a reading and understanding of the specification. It is intended that all such modifications and alterations may be included insofar as they come within the scope of the patent as claimed or the equivalents thereof.

Thus having described the invention, the following is claimed:

1. An anode assembly for use with a rotating drum cathode in an electrolytic solution in an electrodeposition process comprising:

a conductive grid dimensioned to be positioned within said electrolytic solution adjacent said drum cathode, said grid comprised of a copper core and a titanium layer totally encasing said copper core exposed to said electrolytic solution, a plurality of relatively thin, rigid titanium anode plates formed to have a concave cross-section with a radius of curvature slightly greater than the radius of curvature of said drum cathode and a width equal to a circumferential portion of said drum, and a plurality of spaced-apart titanium mounting blocks on said grid for positioning and mounting said anode plates thereto, said mounting blocks in electrically conductive engagement with said copper core and positioning said anode plates side-by-side about said drum cathode wherein said anode plates form a generally continuous surface about the immersed portion of said drum cathode, each of said mounting blocks engaging the adjacent lateral edges of adjacent anode plate wherein each plate is cantilevered at each lateral edge, said edges secured to said mounting blocks wherein current is applied to each anode plate only through the lateral edges thereof.

2. An anode assembly as defined in claim 1 wherein each lateral edges of an anode plate is welded to a different mounting block.

3. An anode assembly as defined in claim 2 wherein said titanium mounting blocks are spaced-apart mounts having machined surface portion dimensioned to receive the lateral edges of said anode plates.

4. An anode structure for use adjacent a cathode having a shape, comprising:

conductive anode grid formed of a core of copper or an alloy thereof, a protective coating encasing said copper core, spaced-apart mounting means formed of an inert, conductive metal mounted to said grid, said inert metal bonded to said copper grid wherein a metallic and electrical bond exists between said inert metal and said cooper, and a thin, rigid anode sheet having an active anode portion and a configuration generally matching said shape of said cathode and spaced-apart anode edge portions, said anode sheet mounted only along said anode edge portions to said mounting means wherein said active anode portion maintains its predetermined configuration and is substantially unsupported between said spaced-apart anode mounting means.

5. An anode structure as defined in claim 4 wherein said anode mounts are current distribution members.

6. An anode structure as defined in claim 4 wherein said protective coating is titanium and said anode mounts are titanium.

7. An anode structure as defined in claim 4 wherein said anode sheet is a thin titanium plate.

8. An anode structure as defined in claim 4 wherein said anode sheet is shaped to conform to the surface of said cathode.

9. An anode structure as defined in claim 4 wherein said anode sheet is welded to said anode mounts.

10. An apparatus for electrodepositing metal onto a rotating drum cathode partially immersed in an electrolyte solution, comprising:

a grid dimensioned positioned within said electrolyte solution adjacent said drum cathode, said grid formed of substantially of copper or an alloy thereof, a protective layer of a non-corrosive conductive metal selected from a group consisting of titanium, columbium, stainless steel, and alloys thereof, covering all surfaces of said copper exposed to said electrolyte solution, a plurality of rigid, yet flexible preformed plates formed of an electrically conductive metal inert to said electrolyte solution, each of said plates having a radius of curvature slightly larger than the radius of curvature of said drum cathode, a plurality of conductive mounting locations formed on said grid, said mounting locations aligned on said grid to receive the edges of said plates only and to position said plates side-by-side about the periphery of said drum, each mounting location dimensioned to receive and to position the adjacent edges of adjacent plates, said mounting locations bonded to said copper grid wherein a metallic and electrical bond exists between said mounting locations and said grid, and means for electrically connecting each edge of a plate to its respective mounting locations wherein current is applied to each of said plates through said grid and conductive mounting locations to the edges thereof.

11. An apparatus as defined in claim 10 wherein said plates are formed of titanium or an alloy thereof, and said plates are welded to said mounting location.

12. An anode assembly for use with a rotating drum cathode in an electrolytic solution in an electrodeposition process comprising:

a copper grid positioned within said electrolytic solution adjacent said drum cathode, a protective layer encasing said copper grid, a plurality of relatively thin, generally rectangular titanium plates, said plates formed to have a concave cross-section with a radius of curvature slightly greater than the radius of curvature of said drum cathode, and a plurality of titanium mounting means on said grid for positioning and mounting said anode plates thereto, said mounting means bonded to said copper grid to form a metallic and electrical bond therebetween and positioning said anode plates side-by-side about said drum cathode wherein said anode plates form a generally continuous surface about the immersed portion of said drum cathode, each of said mounting means only engaging the adjacent lateral edges of adjacent anode plate, said edges secured to said surface means wherein current is applied to each plate through the lateral edges thereof.

13. An anode to be immersed in an electrolytic solution adjacent a moving cylindrical cathode, comprising:

an electrical conductive grid which is clad with an insoluble metal, said grid having a plurality of anode mounting surfaces formed thereon, said mounting surfaces formed of an insolubly, conductive metal and bonded to said conductive grid wherein a metallic and electrical bond exists between said mounting surfaces and said conductive grid, said mounting surfaces dimensioned to position and support side-by-side a plurality of relatively thin rigid, yet flexible insoluble anode plates, said anode plates shaped to be secured to said mounting surfaces only by the edges thereof wherein continuous metal contact exists between said plates and said mounting surfaces and current is applied to said plates through said mounted edges, said plates being dimensioned such that they form a generally continuous cylindrical anode surface which conform to said moving cathode and form a generally uniform gap therewith when said plates are mounted to said grid.

14. An anode assembly for emersion in an electrolytic solution adjacent a moving cathode, comprising:

a grid formed of a first metal which is electrically conductive, a plurality of spaced-apart anode mounting surfaces, a cladding including encasing said grid, said cladding formed of a second metal which is less conductive than said first metal and which is insoluble in electrolytic solution, said mounting surfaces bonded to said grid wherein a metallic and electrical bond exists between said first metal and said second metal, a plurality of relatively thin, rigid yet slightly flexible anode plates for mounting a said anode mounting surfaces, said anode plates having first and second lateral edges for attachment to said anode mounting surfaces, said first lateral edge attached to one mounting surface and said second lateral edge attached to a second monitor surface wherein said anode plate is unsupported between said one mounting surface and said second mounting surface, and lateral edges of said anode plates secured to said mounting surfaces to form continuous metal contact therewith.

15. An anode assembly as defined in claim 14 wherein said lateral edges of said anode plates were welded to said mounting surfaces.

* * * * *